United States Patent [19]

Balius

[11] 4,078,516

[45] Mar. 14, 1978

[54] PROPELLER GUARD

[76] Inventor: Donald G. Balius, 1003 Caillavet St., Biloxi, Miss. 39530

[21] Appl. No.: 759,266

[22] Filed: Jan. 14, 1977

[51] Int. Cl.[2] ..... B63B 35/08

[52] U.S. Cl. ..... 115/42

[58] Field of Search ..... 115/42, 40; 56/400.21

[56] References Cited

U.S. PATENT DOCUMENTS

| | | | |
|---|---|---|---|
| 1,620,129 | 3/1927 | Peterson | 115/42 |
| 2,136,628 | 11/1938 | Lundell | 115/42 |
| 2,244,217 | 6/1941 | Pries | 115/42 |
| 2,983,246 | 5/1961 | Manley | 115/42 |
| 3,035,538 | 5/1962 | Willard | 115/42 |
| 3,889,624 | 6/1975 | Balius | 115/42 |

FOREIGN PATENT DOCUMENTS

| | | | |
|---|---|---|---|
| 564,057 | 9/1958 | Canada | 115/42 |
| 17,854 | 3/1907 | Norway | 115/42 |

*Primary Examiner*—Trygve M. Blix
*Assistant Examiner*—Edward M. Wacyra
*Attorney, Agent, or Firm*—Clarence A. O'Brien; Harvey B. Jacobson

[57] ABSTRACT

A cage-type enclosure is provided for the lower end portions of the upstanding power leg of an outboard marine propulsion unit from which the propeller of the unit is journaled with the cage enclosing the propeller and thus protecting the latter from fouling by weeds and other underwater debris and also serving to prevent accidental injury due to body portions of persons disposed in the water adjacent the propulsion unit from coming in contact with the enclosed propeller. The cage is generally egg-shaped in horizontal plan, inverted U-shaped in vertical transverse section and fin-shaped in side elevation including a forwardly and upwardly curving forward end portion, a substantially vertical rear end portion and a horizontal upper portion. The cage includes clamp structure at its upper end for removable clamped support from the power leg of the associated outboard marine propulsion unit adjacent the cavitation plate thereof.

7 Claims, 4 Drawing Figures

Fig. 1
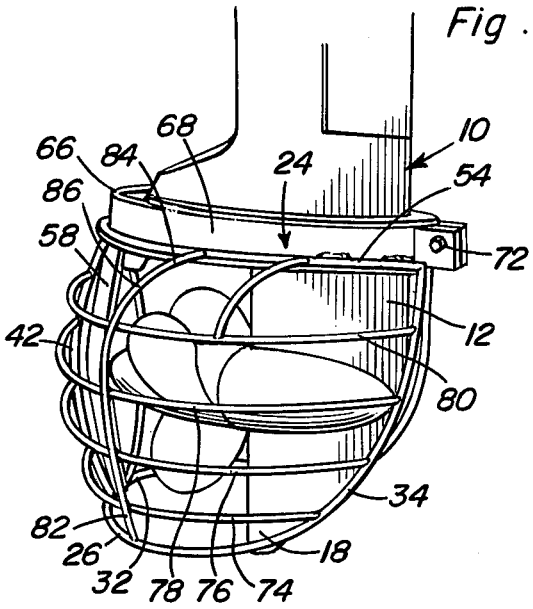
Fig. 4
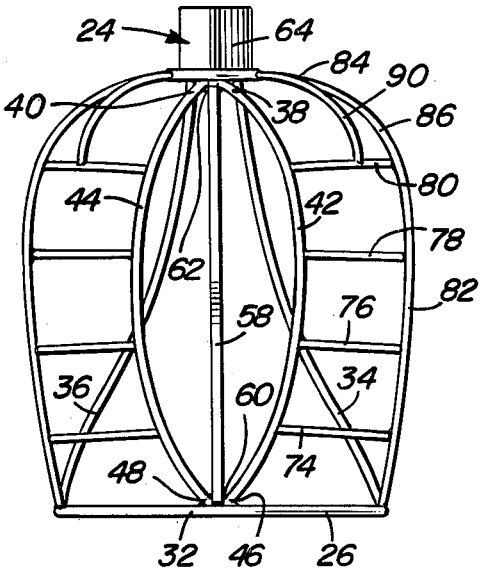
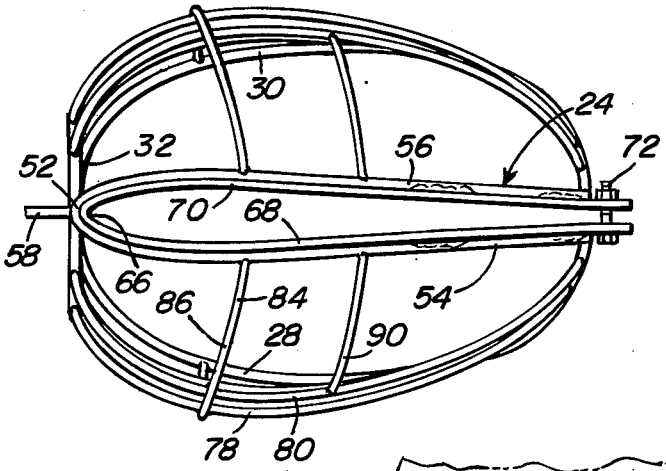
Fig. 2
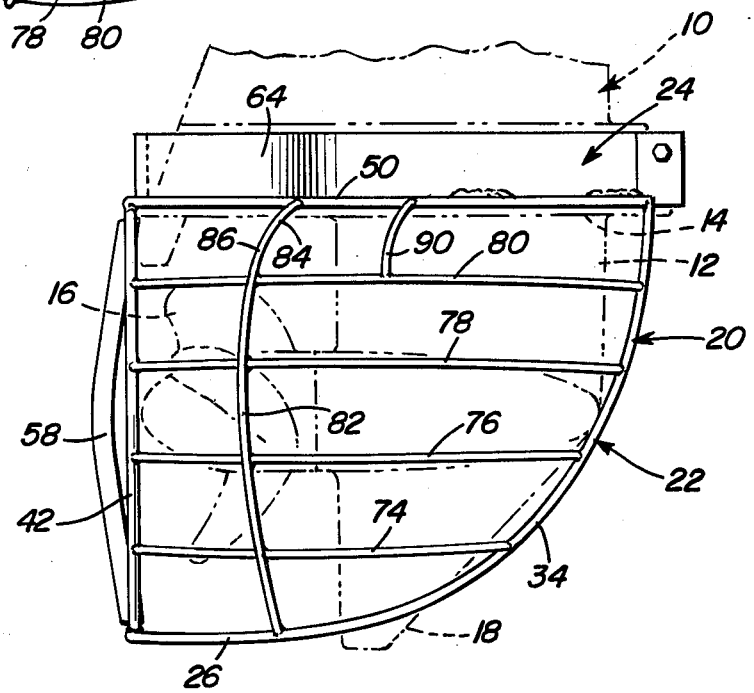
Fig. 3

PROPELLER GUARD

BACKGROUND OF THE INVENTION

Various forms of outboard motor and outdrive propeller guard assemblies have been heretofore designed, but most of these previous propeller guard assemblies have been of the type whereby considerable resistance to their passage through water is a direct result of their construction and configuration and little protection to the associated marine propulsion unit and its propeller is afforded. Examples of previously patented propeller guards are disclosed in U.S. Pat. Nos: 1,620,129, 2,244,217, 2,355,842, 2,470,874, 3,314,392, 3,802,377, Canadian Pat. No. 564,057, German Pat. No. 90,330, Norwegian Pat. No. 17,854, and French Pat. No. 1,289,967. However, the propeller guard disclosed in my prior U.S. Pat. No. 3,889,624 is deemed to be closest in construction and operation to the propeller guard of the instant invention.

BRIEF DESCRIPTION OF THE INVENTION

The propeller guard of the instant invention includes a forwardly and downwardly opening rod cage constructed of contoured, crossed and interconnected rod members with the rear end of the cage provided with a discharge opening protected by a center vertical portion of the cage. The upper end of the cage includes a clamp bracket for attachment to the associated outboard motor or outdrive power leg and the cage not only functions as a guard against body portions of swimmers, or the like, from coming into contact with the associated propeller, but also as a guard against the propeller being fouled by underwater debris, such as weeds. Still further, the guard also functions to protect the lower end of the power leg and its propeller against impact with solid underwater objects. The cage includes upstanding opposite side portions and the forward lower marginal portions of the opposite side portions of the cage curve forwardly and upwardly whereby to guide the power leg lower portion from which the cage is supported over solid underwater objects by rearward upward tilting of the power leg as a result of the cage striking an underwater object.

In addition, the cage is constructed whereby it offers maximum protection of the type desired with minimal resistance to its movement through the water and is also constructed in a manner whereby it will shield the associated power leg lower end portion and the propeller journaled therefrom against impact from either side in the event an underwater object is struck while making a sharp turn.

The main object of this invention is to provide a propeller guard for an outboard motor or a stern drive unit and constructed in a manner whereby the guard will substantially fully enclose the propeller of the associated drive unit and thus render it nearly impossible for swimmers to come in contact with the propeller or the propeller to come in contact with the bottom or other submerged objects when running in shoal waters.

Another object of this invention is to provide a propeller guard constructed in a manner so as to offer maximum protection to the associated drive unit while affording minimal resistance to its movement through the water.

Still another object of this invention is to provide a propeller guard constructed in a manner whereby it may be readily removed from engagement with and reinstalled on various forms of drive units.

A final object of this invention to be specifically enumerated herein is to provide a propeller guard in accordance with the preceding objects and which will conform to conventional forms of manufacture, be of simple construction and easy to install so as to provide a device that will be economically feasible, long lasting and relatively trouble free in installation.

These together with other object and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary, perspective view of a marine propulsion unit of the outboard type with the guard of the instant invention mounted thereon and substantially fully enclosing the propeller of the drive unit;

FIG. 2 is an enlarged, top, plan view of the drive unit;

FIG. 3 is an enlarged, side, elevational view of the guard with an associated drive unit lower end portion illustrated in phantom lines; and FIG. 4 is a rear elevational view of the propeller guard.

DETAILED DESCRIPTION OF THE INVENTION

Referring now more specifically to the drawings, the numeral 10 generally designates a conventional form of marine propulsion unit of the outboard type including an upstanding power leg 12 having a horizontal cavitation plate 14 extending peripherally thereabout. The lower end of the unit 12 journals a marine propeller 16 therefrom for rotation about a horizontal front to rear extending axis and the unit 12 terminates downwardly in a depending skeg portion 18 which projects below the propeller 16.

The propeller guard of the instant invention is referred to in general by the reference numeral 20 and includes a cage referred to in general by the reference numeral 22 removably clampingly supported from the unit 10 by means of a clamp assembly referred to in general by the reference numeral 24. The cage 22 includes a lower portion 26 defining an elongated U-shaped member including a pair of opposite side legs 28 and 30 interconnected at their rear ends by means of an integral smoothly curved bight portion 32. The forward ends of the legs 28 and 30 curve smoothly upwardly as at 34 and 36 and terminate upwardly in laterally spaced apart substantially vertical upper ends 38 and 40. A pair of opposite side upstanding and arcuate elongated rear end members 42 and 44 are provided and their lower ends are disposed closely adjacent each other and are secured as at 46 and 48 to the central portion of the bight portion 32. The upper ends of the end members 42 and 44 curve inwardly toward each other and terminate in substantially horizontal alignment with the upper extremities of the upper end portions 38 and 40. An upper portion 50 in the form of an elongated rod member is provided and is bent centrally intermediate its opposite ends as at 52 to define a pair of opposite side horizontal leg portions 54 and 56. The upper ends of the end members 42 and 44 are anchored, fixedly, to the bent portion 52 and the upper end portions 38 and 40 are anchored to the forward free ends of the leg portions 54 and 56.

The end members 42 and 44 are arcuate and open toward each other and thereby define a central rearward opening therebetween. A heavy gauge upstanding and substantialy vertical member 58 is disposed in the aforementioned opening and bisects the latter. The lower end of the vertical member 58 is anchored to the central portion of the bight portion 32 between the lower ends of the end members 42 and 44 as at 60 and the upper end of the vertical member 58 is secured to the reversely bent portion 52 intermediate the upper ends of the end members 42 and 44 as at 62.

The clamp assembly comprises an elongated strap member 64 bent back upon itself as at 66 in order to form a pair of opposite side members 68 and 70 joined together at their rear ends. The forward ends of the opposite side members 68 and 70 are provided with aligned transverse horizontal bores through which a clamp-type fastener 72 is removably secured. The contour of the upper portion or rod member 50 closely conforms to the contour of the strap member 64 and the rod member 50 overlies and is secured to the outer surfaces of the lower marginal edge of the strap member 64 at points spaced therealong.

A pair of opposite side sets of elongated, vertically spaced, horizontally disposed and inwardly concave arcuate side members 74, 76, 78 and 80 are provided and the rear corresponding ends of the side members are anchored to vertically spaced portions of the corresponding end members 42 and 44 and the forward ends of each set of side members are secured to the forwardly and upwardly curving portion of the corresponding leg of the lower portion 26 at points spaced therealong. In addition, the cage 22 includes a pair of elongated opposite side bracing members each including an upstanding lower leg 82 and an upper horizontal leg 84 into which a curved upper end 86 of the leg 82 smoothly merges. The lower end of each leg 82 is anchored to the corresponding leg of the lower portion 26 adjacent its juncture with the bight portion 32 and the end of each horizontal leg 84 remote from the associated upstanding leg 82 is anchored to the corresponding leg portion of the upper portion or rod member 50 centrally intermediate its opposite ends. The upstanding legs, at points spaced therealong, cross and are anchored, to the corresponding side members 74, 76, 78, and 80. Still further, an inwardly and downwardly opening arcuate bracing rod 90 is provided on the upper portion of each side of the cage 22 and has its upper end anchored to the corresponding leg portion of the upper portion or rod member 50 and its lower end anchored to the longitudinal midportion of the corresponding side member 80.

In operation, the fastener 52 may be removed and the forward end of the cage 22 may be spread apart and forwardly and downwardly advanced relative to the unit 12 so as to position the cage 22 in generally the position thereof illustrated in FIG. 1 with the clamp assembly 24 immediately overlying the cavitation plate 14. Then, the forward end of the cage may have its opposite side portions urged toward each other and the fastener 72 may be reinstalled and tightened in order to clamp the forward portions of the clamp assembly 24 tightly about the unit 12. With the cage 22 thus mounted from the unit 12, the propeller 16 is substantially fully enclosed within the cage 22 and the forwardly and upwardly curving legs 34 and 36 offer protection to the unit 12 against striking underwater objects. In addition, the downwardly and rearwardly curving forward marginal portions of the cage 22 offer little resistance to passage through the water as do the inwardly curving forward ends of the side members 74, 76, 78, and 80. Further, the bracing members including the legs 82 and 84 thereof offer little resistance to passage through the water and the rear end of the cage 22 includes a rear opening defined between the upstanding end members 42 and 44, the opening being divided into two opening segments by means of the vertical member 58. However, the members 42, 44, and 58 offer little resistance to movement through the water.

The propeller guard disclosed in my above prior U.S. Pat. No. 3,889,624 includes full rear transverse vertically spaced rod members which tend to offer considerable resistance to movement through the water and those portions of my prior propeller guard corresponding to the legs 34 and 36 include transversely widened flange members which also offer considerable resistance to passage through the water. Still further, the bracing of the cage 22 at the rear end thereof by means of the upstanding members 42 and 44 and the vertical member 50 offers considerable resistance to lateral deflection of the cage 22 relative to the unit 12 and thus protects the latter against impact from lateral directions when an associated boat is making a sharp turn to avoid shoal waters, and it will be noted that the vertical member 50 is not in the form of a rod member, but rather a strip member which is rearwardly bowed to offer maximum protection against bending should the guard 20 strike an underwater object while the associated boat is operating in reverse. Also, the vertical member 50 tends to reduce the turbulance of the rearward discharge of water from the associated propeller while offering minimum resistance to its movement through the water.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A propeller guard comprising a cage constructed of contoured, crossed and interconnected elongated rod members, said cage including a lower portion defined by an elongated U-shaped member including a pair of opposite side legs interconnected at one pair of corresponding ends by means of an integral smoothly curved bight portion extending therebetween, said bight portion being substantially horizontally disposed and said legs curving upwardly toward the other pair of corresponding ends thereof with said other pair of corresponding ends being upwardly convergent, a pair of opposite side upstanding and arcuate elongated end members positioned with their concave sides opening toward each other and including adjacent lower ends secured to the central portion of said bight portion and adjacent upper ends generally horizontally aligned with the upper terminal ends of said other pair of corresponding ends of said legs, an elongated horizontal clamp structure including opposite end portions as well as opposite side portions extending between said opposite end portions, the upper ends of said upstanding end members and said other ends of said legs being anchored to opposite end portions of said clamp structure, said clamp structure including means for clamping engagement about the lower portion of the upstanding power leg of an outboard marine propulsion unit adjacent the horizontal cavitation plate thereof, said cage including a pair of opposite side sets of elongated vertically spaced, horizontally disposed and inwardly concave arcuate side members, one set of corresponding ends of each set of said side members being anchored to portions of the corresponding side leg at points spaced along the upwardly curving end thereof and the other set of corresponding ends of the sets of said side members being anchored to the corresponding upstanding end members at points spaced therealong, said clamp structure comprising a stiff band member reversely bent centrally intermediate its opposite ends to form a pair of elongated opposite side members defining said clamp structure opposite side portions and integrally jointed together at one pair of corresponding ends and fastener means removably secured through terminal ends of the other pair of corresponding ends of said band member side members, the upper ends of said end members being secured to the reversely bent portion of said band member and said other pair of ends of said legs being anchored to said pair of corresponding ends of said band member side members.

2. The combination of claim 1, wherein said cage includes a pair of elongated opposite side bracing members each including an upstanding leg and an upper horizontal leg into which a curved upper end of said upstanding leg smoothly merges, the lower end of each upstanding leg being anchored relative to the corresponding side leg adjacent the juncture thereof with said bight portion, the end of each horizontal leg remote from the associated upstanding leg being anchored to the corresponding clamp structure side portion centrally intermediate its opposite ends, and said upstanding legs each being anchored, at points spaced therealong, to the corresponding side members intermediate their opposite ends.

3. A propeller guard comprising a cage constructed of contoured, crossed and interconnected elongated rod members, said cage including a lower portion defined by an elongated U-shaped member including a pair of opposite side legs interconnected at one pair of corresponding ends by means of an integral smoothly curved bight portion extending therebetween, said bight portion being substantially horizontally disposed and said legs curving upwardly toward the other pair of corresponding ends thereof, a pair of opposite side upstanding and arcuate elongated end members positioned with their concave sides opening toward each other and including adjacent lower ends secured to the central portion of said bight portion and adjacent upper ends generally horizontally aligned with the upper terminal ends of said other pair of corresponding ends of said legs, an elongated horizontal clamp structure including opposite end portions as well as opposite side portions extending between said opposite end portions, the upper ends of said upstanding end members and said other ends of said legs being anchored to opposite end portions of said clamp structure, said clamp structure including means for clamping engagement about the lower portion of the upstanding power leg of an outboard marine propulsion unit adjacent the horizontal cavitation plate thereof, said cage including a pair of opposite side sets of elongated vertically spaced, horizontally disposed and inwardly concave arcuate side members, one set of corresponding ends of each set of said side members being anchored to portions of the corresponding side leg at points spaced along the upwardly curving end thereof and the other set of corresponding ends of the sets of said side members being anchored to the corresponding upstanding end members at points spaced therealong, a generally vertical member disposed between said end members, the lower end of said vertical member being anchored to said bight portion between the lower ends of said end members, the upper end of said vertical member being anchored to the rear end portion of said clamp structure between the upper ends of said end members.

4. The combination of claim 3, wherein said vertical member comprises an elongated rigid strap member of greater width than thickness and said vertical member is disposed with its greater width dimension extending in a front-to-rear direction.

5. The combination of claim 4, wherein said vertical member includes rearwardly and upwardly and rearwardly and downwardly angled relatively angulated lower and upper end portions, respectively.

6. The combination of claim 5, wherein said cage includes a pair of elongated opposite side bracing members each including an upstanding leg and an upper horizontal leg into which a curved upper end of said upstanding leg smoothly merges, the lower end of each upstanding leg being anchored relative to the corresponding side leg adjacent the juncture thereof with said bight portion, the end of each horizontal leg remote from the associated upstanding leg being anchored to the corresponding clamp structure side portion centrally intermediate its opposite ends, and said upstanding legs each being anchored, at points spaced therealong, to the corresponding side members intermediate their opposite ends.

7. The combination of claim 6, wherein said clamp structure comprises a stiff band member reversely bent centrally intermediate its opposite ends to form a pair of elongated opposite side members integrally joined together at one pair of corresponding ends and fastener means removably secured through the other pair of corresponding ends of said band member side members.

* * * * *